US005829593A

United States Patent [19]

Appleton

[11] Patent Number: 5,829,593

[45] Date of Patent: Nov. 3, 1998

[54] INTEGRAL THERMOPLASTIC PACKAGE FOR RECEIVING AN ARTICLE

[75] Inventor: Donald J. Appleton, Rochester, N.Y.

[73] Assignee: Eastman Kodak Company, Rochester, N.Y.

[21] Appl. No.: 915,811

[22] Filed: Aug. 21, 1997

[51] Int. Cl.[6] ..... B65D 85/30

[52] U.S. Cl. ..... 206/454; 206/470; 206/778; 220/6

[58] Field of Search ..... 206/461, 467, 206/470, 471, 775, 776, 778, 782, 449, 454, 455, 456, 425; 220/4.05, 6

[56] References Cited

U.S. PATENT DOCUMENTS

| | | | |
|---|---|---|---|
| 4,776,462 | 10/1988 | Kosugi et al. | 206/454 |
| 4,805,769 | 2/1989 | Soltis et al. | 206/309 |
| 5,090,568 | 2/1992 | Tse | 206/456 |
| 5,147,035 | 9/1992 | Hartman | 206/45.23 |
| 5,209,354 | 5/1993 | Thornhill et al. | 206/469 |
| 5,351,824 | 10/1994 | Cox | 206/387 |
| 5,377,836 | 1/1995 | Eisenbraum | 206/461 |
| 5,472,091 | 12/1995 | Hewitt et al. | 206/455 |
| 5,595,300 | 1/1997 | Paik et al. | 206/449 |

*Primary Examiner*—Jacob K. Ackun
*Attorney, Agent, or Firm*—David M. Woods

[57] ABSTRACT

A package is formed from an integral sheet of a thermoplastic material having three tray portions including a middle tray portion and first and second end tray portions that fold together to form the package. The middle tray portion has a first article receiving recess and is arranged to define a first receiving cavity for the first end tray portion. The first end tray portion has a mating surface, a second article receiving recess and a first hinge connected to the middle tray portion. The hinge permits the first end tray portion to be inserted into the middle tray portion with the first and second article receiving recesses aligned to secure the article. The mating surface of the first end tray portion after being inserted into the first receiving cavity of the middle tray portion defines a second receiving cavity. The second end tray portion has a second hinge connected to the middle tray portion which permits the second end tray portion to be inserted into the second receiving cavity, whereby a package for the article is formed with the tray portions folded together in a manner that inhibits pilferage.

12 Claims, 4 Drawing Sheets

INTEGRAL THERMOPLASTIC PACKAGE FOR RECEIVING AN ARTICLE

FIELD OF THE INVENTION

The invention relates generally to the field of packaging. More specifically, the invention relates to the packaging of articles, where the packaging is formed from an integral sheet of transparent thermoplastic material.

BACKGROUND OF THE INVENTION

It is well known practice to use transparent thermoplastic material in the packaging of articles such as digital camera flash cards (memory cards), which are sold in retail stores. Typically, such packaging incorporates a two piece packaging system, in which the article to be packaged is placed between the two piece package and then is sealed closed either through sonic welding or friction closures utilizing buttons or posts. For the distributor of the packaged article, the two piece packaging system is simple, inexpensive and provides for easy display for the consumer. However, this type of packaging system lends itself to easy pilferage. Often shoplifters are able to remove the contents of the package virtually unnoticed. The shoplifters are able to ply the package open at the point where the two pieces connect.

It has been found that an integral package composed of multiple sections would provide for more structural integrity. U.S. Pat. No. 5,595,300, entitled Apparatus for Holding and Dispensing Flat Articles, shows an integral package designed to allow both easy viewing and easy opening at one end for dispensing of flat articles. It would be useful to have an integral design which would discourage easy opening and consequential pilferage.

SUMMARY OF THE INVENTION

The present invention is directed to overcoming one or more of the problems set forth above. Briefly summarized, the present invention provides a package which is easy to manufacture, but increases the level of difficulty of disassembly to prevent pilferage.

This object is achieved by an integral sheet formed of a thermoplastic material molded to form a package for an article, comprising:

three tray portions including a middle tray portion and first and second end tray portions;

the middle tray portion having a first receiving cavity and arranged to define first means for receiving the article wherein the first article receiving means is of a size less than the size of the first receiving cavity;

the first end tray portion having a mating surface and defining a second means for receiving the article wherein the second article receiving means is of a size less than the size of the mating surface, and a first hinge connected to the middle tray portion which permits the first end tray portion to be inserted into the first receiving cavity of the middle tray portion with the first and second article receiving means aligned to secure the article, the mating surface of the first end tray portion after being inserted into the first receiving cavity of the middle tray portion defining a second receiving cavity; and the second end tray portion being at least half the length of the middle tray portion and having a second hinge connected to the middle tray portion which permits the second end tray portion to be inserted into the second receiving cavity, whereby a package for the article is formed.

A feature of the present invention is to hinge the first and second end tray portions to the middle tray portion to permit the first end tray portion to be inserted into the middle tray portion and the second end tray portion to be inserted into the cavity created by the insertion of the first end tray portion into the middle tray portion.

Another feature of the present invention is to provide a slot between the bases of the assembled end tray portions for the storage of flat paper articles to accompany the packaged article.

These and other aspects, objects, features and advantages of the present invention will be more clearly understood and appreciated from a review of the following detailed description of the preferred embodiments and appended claims, and by reference to the accompanying drawings.

ADVANTAGES

An advantage of the present invention is to provide a package, for receiving articles such as digital camera flash cards, which includes three integrally molded thermoplastic tray portions that can be readily assembled to receive an article but are relatively difficult to disassemble without drawing attention.

Another advantage of the present invention is that the tray portions are made of a material which is recyclable. The consumer is able to discard the packaging in recycle collection bins along with other household recyclable products. It is possible to use other materials, such as PVC and polystyrene, to manufacture this package, but these materials are negatively perceived by society because of their inability to be recycled.

A further advantage of the present invention is that the present invention is inexpensive to manufacture.

BRIEF DESCRIPTION OF THE DRAWINGS

The aforementioned aspects of the present invention will become more apparent from the following detailed description taken in conjunction with the accompanying drawings showing a preferred embodiment wherein.

DETAILED DESCRIPTION OF THE INVENTION

Figure 1:
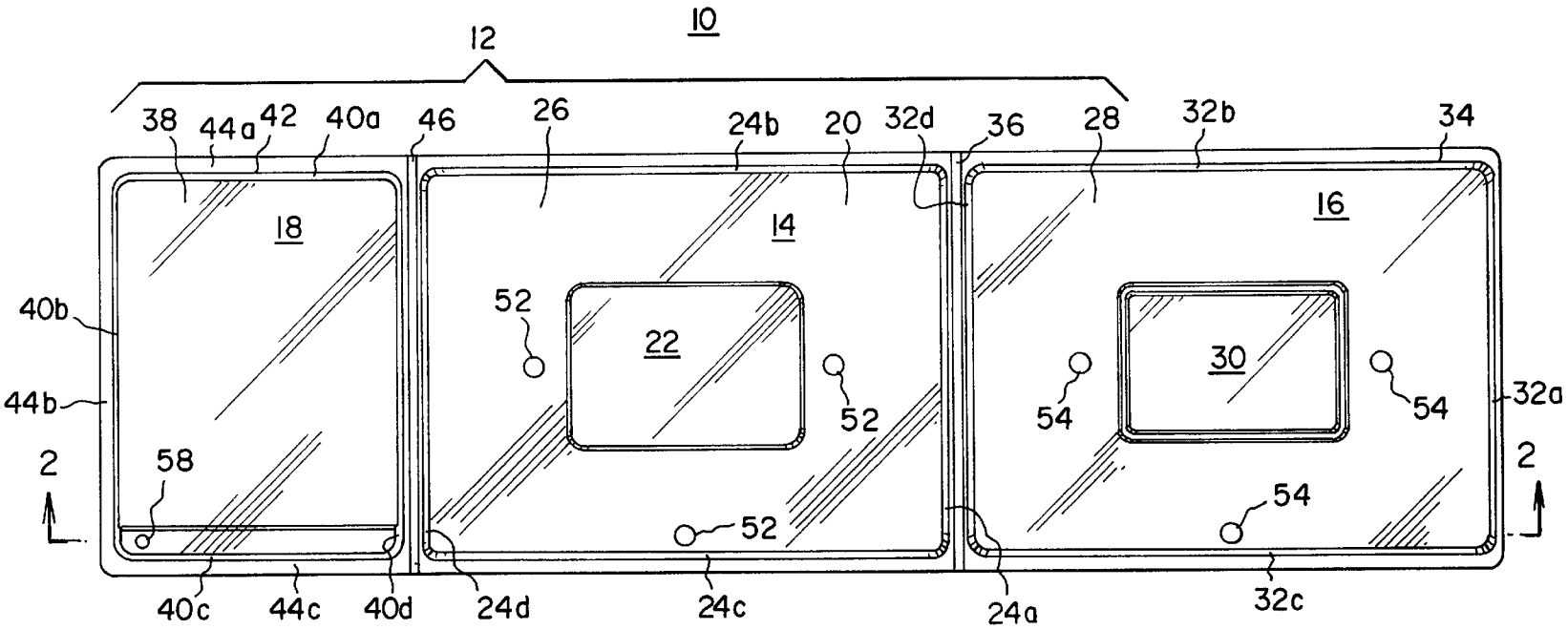
FIG. 1 is a top view showing an unassembled package in accordance with the present invention.

Referring to FIG. 1, a package 10 is formed from an integral sheet 12 of a thermoforming material. For example, the thermoforming integral sheet 12 is made of a glycol modified polyethylene terphthalate material (known as PETG). It has been found preferable to have the thermoplastic material transparent and capable of being molded in a single injection molding operation. The PETG material is preferable because of its recycling ability.

Figure 2:
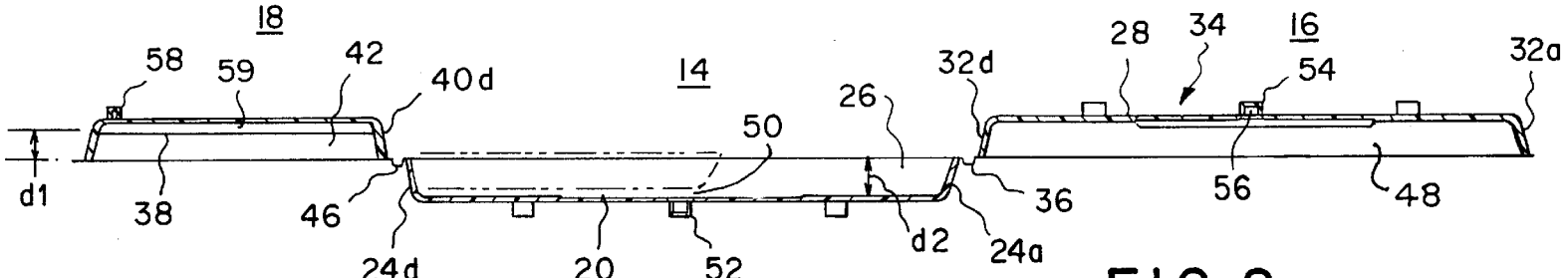
FIG. 2 is a sectional view taken along the line 2—2 of FIG. 1.

The package 10 has three tray portions including a middle tray portion 14 and first and second end tray portions, 16 and 18 respectively. With reference to FIGS. 1 and 2, the middle tray portion 14 has a first base 20 formed with a first article receiving means, such as a recess 22, and first walls 24 *a, b, c, d* arranged with respect to the first base 20 to define a first receiving cavity 26. As shown, the first walls 24 *a, b, c, d* are arranged to form the sides of the first receiving cavity 26.

Figure 3:
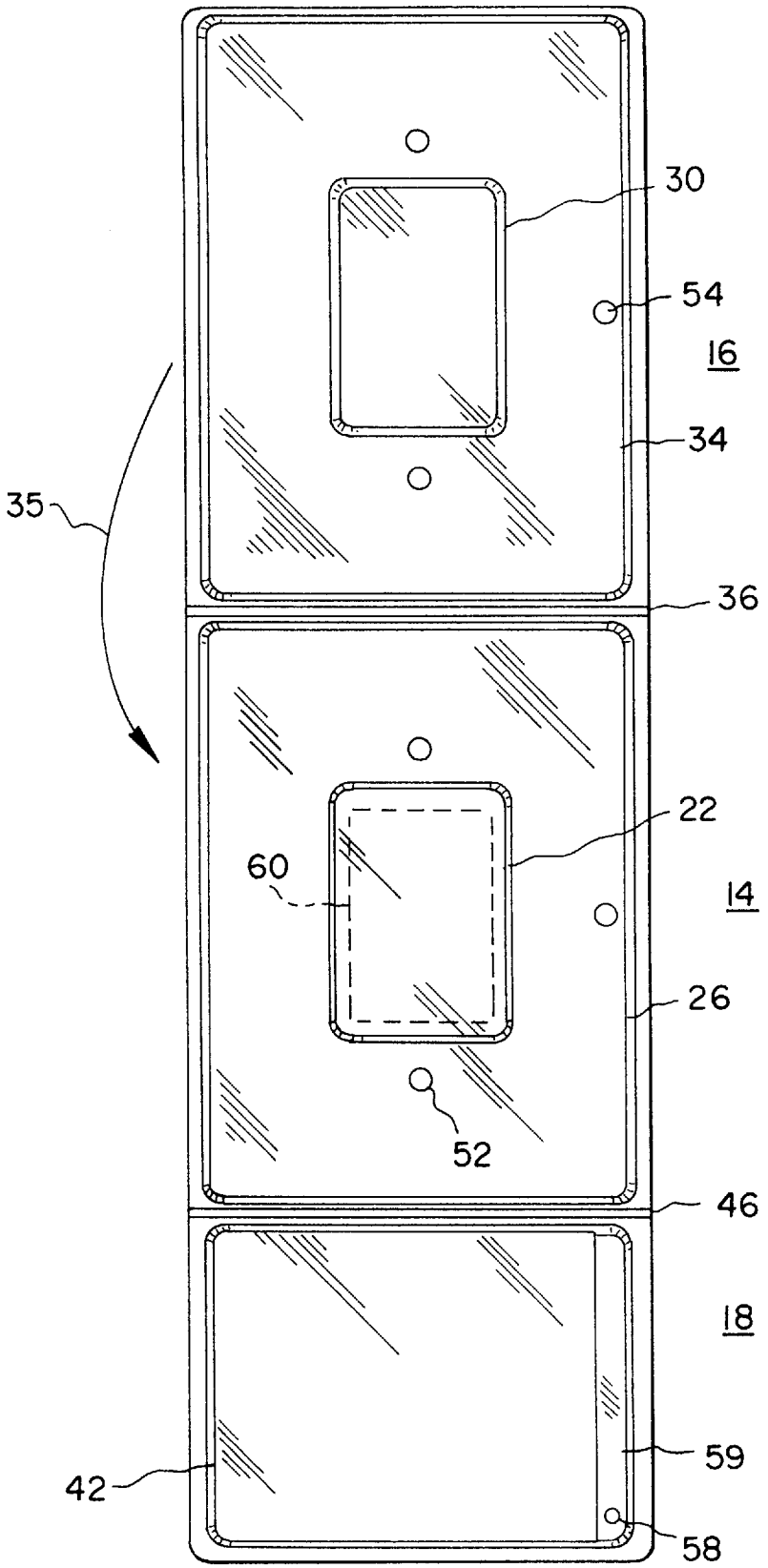
FIG. 3 is a view of unassembled package of FIG. 1.
Figure 4:
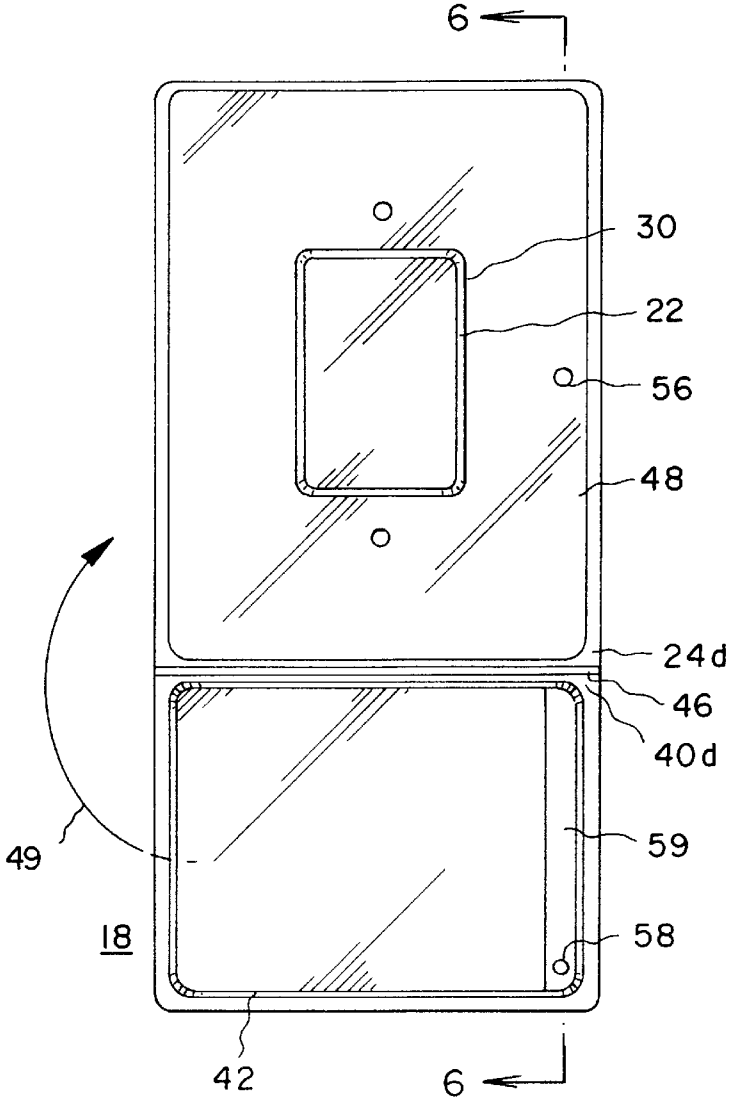
FIG. 4 is a view of partially assembled package.

The first end tray portion 16 has a second base 28 formed with a second article receiving means, such as a recess 30. The first end tray portion 16 has second walls 32 *a, b, c, d* arranged with respect to the second base 28 to define a mating surface 34. As shown in FIG. 2, the first wall 24*a* and second wall 32*d* are connected to form a first hinge 36. As shown in FIGS. 3 and 4, and in cross section in FIG. 6, the first hinge permits the first end tray portion 16 to be folded according to the arrow 35 and inserted into the middle tray portion 14 with the first and second receiving recesses 22 and 30 aligned to secure an article 60. While the first hinge 36 may be a single hinge, the first hinge 36 is preferably made to form a double hinge as shown more clearly in FIG. 2 and FIG. 3. The double hinge is important because the PETG material is relatively thick and the double hinge allows the tray portions to bend 180 degrees and fold onto themselves. As shown in FIGS. 2 and 4, the opposite side of the mating surface 34 of the first end tray portion 16, particularly after being inserted into the first receiving cavity 26 of the middle tray portion 14, defines a second receiving cavity 48.

Figure 5:
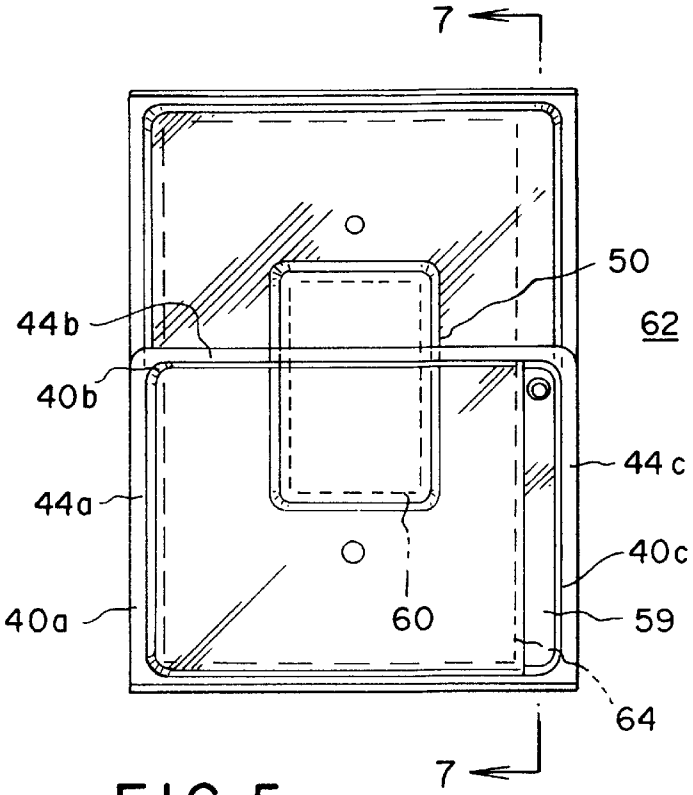
FIG. 5 is a view of the assembled package of FIG. 1.

The second end tray portion 18 has a third base 38 and third walls 40 *a, b, c, d* arranged with respect to the third base 38 to form a third cavity 42. As shown in FIG. 5, lips 44 *a, b, c* are formed on three of the third walls 40 *a, b, c*. The third base 38 has a length less than the length of the second base 28. Preferably, this length is at least half the length of the first base 20 of the middle tray portion 14. Also shown in FIG. 5, it is also preferred to have the second end tray portion 18 to cover at least part of the aligned article receiving recesses 22 and 30. As shown in FIGS. 2 and 4, and in cross section in FIG. 7, the first wall 24*d* and the third wall 40*d* are connected to form a second hinge 46 which permits the second end tray portion 18 to be inserted into the second receiving cavity 48 according to the arrow 49. As in the case of the first hinge 36, the second hinge 46 is preferably a double hinge.

As shown in FIG. 5, when the package is assembled, the lips 44 *a, b, c,* engage the top of the second walls 32 *c, b* of the first end tray portion 16 forming a slot 50 between the second and third bases 28 and 38 of the first end tray portion and the second end tray portion respectively. A ledge 59 on the bottom of the third base 38 also helps to establish the slot 5D. As shown in FIG. 2, dimension d1 defining the thickness of the third cavity 42 is less than dimension d2 defining the thickness of the second receiving cavity 48, such that when the second end tray portion 18 is folded into the second receiving cavity 48, the difference between d1 and d2 creates the slot 50, which allows for the storage of the flat articles (such as instructions) to accompany the packaged article.

Figure 6:
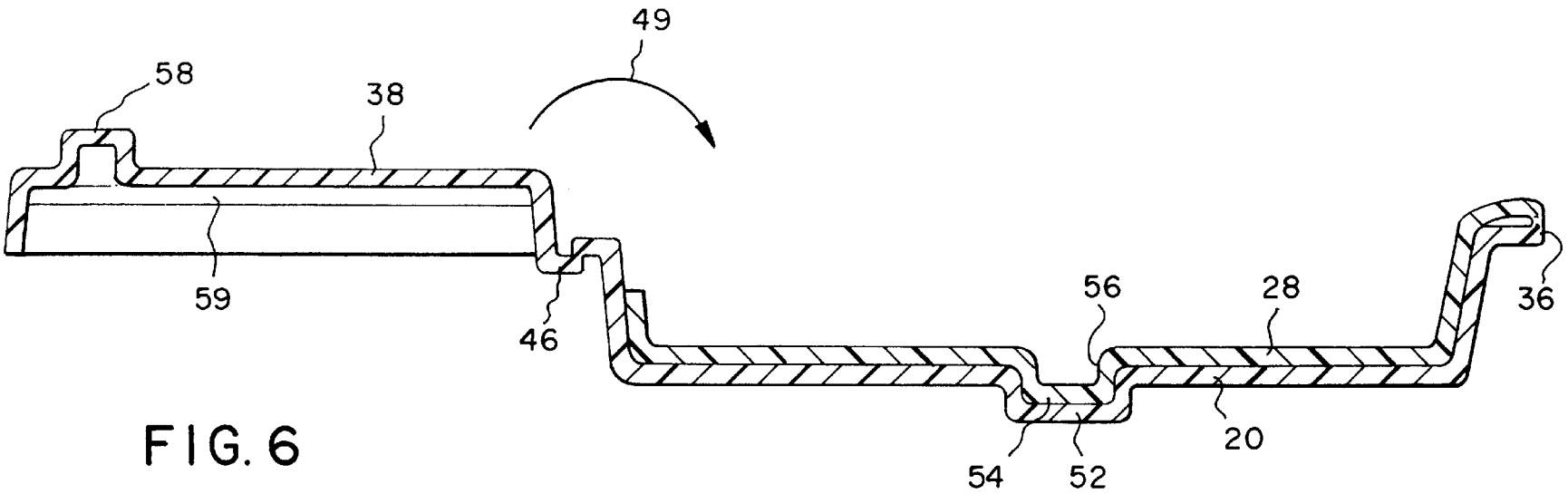
FIG. 6 is a cross section taken along lines 6—6 of the partially assembled package shown in FIG. 4.
Figure 7:
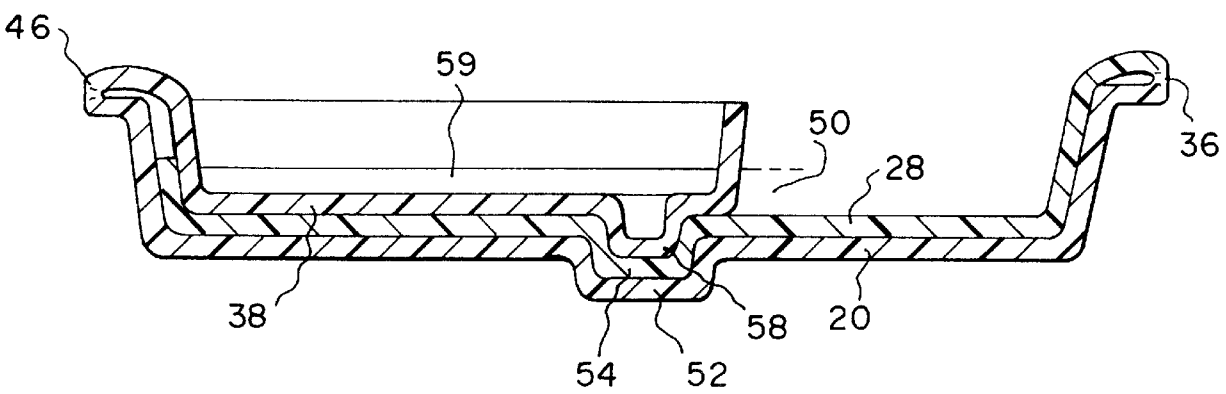
FIG. 7 is a cross section taken along lines 7—7 of the assembled package shown in FIG. 5.

As shown in FIGS. 1 and 2, the middle tray portion 14 is molded with first post receiving recesses 52 and the first end tray portion 16 has first posts 54 corresponding to the first post receiving recesses 52. As shown in FIG. 3, when the mating surface 34 of the first end tray portion 16 is inserted into the first receiving cavity 26 of the middle tray portion 14 according to the arrow 35, the corresponding first posts 54 are inserted in the first post receiving recesses 52 to secure the first end tray portion 16 to the middle tray portion 14. As best shown in cross section in FIG. 6, one of the first posts 54 defines a one second post receiving recess 56. As shown in FIGS. 2 and 6, the second end tray portion 18 has a second post 58 positioned on a ledge 59 formed on the second end tray portion 18, corresponding to the second post receiving recess 56. As shown in FIG. 4, when the second end tray portion 18 is inserted into the second receiving cavity 48 according to the arrow 49, the second post 58 is inserted into the second post receiving recess 56 to secure the second end tray portion 18 to the first end tray portion 16 (as shown in FIG. 7). As shown in FIG. 5 this creates an assembled package 62, which secures and displays the packaged article 60 and the accompanying flat paper articles 64. As shown in the figures, the package is assembled and sealed using friction closures between posts and recesses, but sonic welding at appropriate points can also be used to seal the package. Sonic welding is achieved by emitting ultrasonic waves which create heat and melt the plastic.

Due to the interconnectivity of the three tray portions using the posts, recesses, and friction closures the assembled packaged curtails pilfering. The assembled package design comprising the tray portions being folded onto each other and then fastened together with posts causes the package to be sealed tighter. Thus, the tighter sealed integral package makes it more difficult for shoplifters to remove the article packaged within without completely disassembling the package and drawing attention to themselves.

The invention has been described with reference to a preferred embodiment. However, it will be appreciated that variations and modifications can be affected by a person of ordinary skill in the art without departing from the scope of the invention.

PARTS LIST

10 package
12 integral sheet
14 middle tray portion
16 first end tray portion
18 second end tray portion
20 first base
22 first article receiving recess
24*a, b, c, d* first walls
26 first receiving cavity
28 second base
30 second article receiving recess
32*a, b, c, d* second walls
34 mating surface
35 arrow
36 first hinge
38 third base
40*a, b, c, d* third walls
42 third cavity
44*a, b, c* lips
46 second hinge
48 second receiving cavity
49 arrow
50 slot
52 first post receiving recess
54 first posts
56 second post receiving recess
58 second posts
59 ledge
60 flat article
62 assembled package
64 accompanying paper articles

What is claimed is:

1. A package formed from an integral sheet to receive an article, comprising:

three tray portions including a middle tray portion and first and second end tray portions;

the middle tray portion having a first receiving cavity and arranged to define first means for receiving the article wherein the first article receiving means is of a size less than the size of the first receiving cavity;

the first end tray portion having a mating surface and defining a second means for receiving the article wherein the second article receiving means is of a size less than the size of the mating surface, and a first hinge connected to the middle tray portion which permits the first end tray portion to be inserted into the first receiving cavity of the middle tray portion with the first and second article receiving means aligned to secure the article, the mating surface of the first end tray portion after being inserted into the first receiving cavity of the middle tray portion defining a second receiving cavity; and the second end tray portion being at least half the length of the middle tray portion and having a second hinge connected to the middle tray portion which permits the second end tray portion to be inserted into the second receiving cavity, whereby a package for the article is formed.

2. The package of claim 1 wherein the integral sheet is formed of a transparent thermoplastic material.

3. The package of claim 1 wherein the first and second article receiving means comprises a recess in at least one of the middle tray portion or the first end tray portion.

4. The package of claim 1 wherein the first and second hinge are a double hinge.

5. The package of claim 1 wherein the middle tray portion has one or more first post receiving recesses and the first end tray portion has corresponding first posts combining with at least one of the first post receiving recess defining a second post receiving recess, such that when the mating surface of the first end tray portion is inserted into the first receiving cavity, the corresponding first posts are inserted in the first post receiving recess to secure the first end tray portion to the middle tray portion defining the second post receiving recess, the second end tray portion having at least one second post corresponding to the second post receiving recess such that when the second end tray portion is inserted into the second receiving cavity the second post is inserted into the second post receiving recess to secure the second end tray portion to the first end tray portion.

6. A package formed from an integral sheet to receive an article, comprising:

three tray portions including a middle tray portion and first and second end tray portions;

the middle tray portion having a first receiving cavity and arranged to define first means for receiving the article wherein the first article receiving means is of a size less than the size of the first receiving cavity;

the first end tray portion having a mating surface and defining a second means for receiving the article wherein the second article receiving means is of a size less than the size of the mating surface, and a first hinge connected to the middle tray portion which permits the first end tray portion to be inserted into the first receiving cavity of the middle tray portion with the first and second article receiving means aligned to secure the article, the mating surface of the first end tray portion after being inserted into the first receiving cavity of the middle tray portion defining a second receiving cavity; and the second end tray portion having a second hinge connected to the middle tray portion which permits the second end tray portion to be inserted into the second receiving cavity such that the second end tray portion overlaps at least part of the aligned first and second article receiving means, whereby a package for the article is formed.

7. The package of claim 6 wherein the first and second article receiving means comprises a recess in at least one of the middle tray portion or the first end tray portion.

8. The package of claim 6 wherein the middle tray portion has one or more first post receiving recesses and the first end tray portion has corresponding first posts combining with at least one of the first post receiving recess defining a second post receiving recess, such that when the mating surface of the first end tray portion is inserted into the first receiving cavity, the corresponding first posts are inserted in the first post receiving recess to secure the first end tray portion to the middle tray portion defining the second post receiving recess, the second end tray portion having at least one second post corresponding to the second post receiving recess such that when the second end tray portion is inserted into the second receiving cavity the second post is inserted into the second post receiving recess to secure the second end tray portion to the first end tray portion.

9. The package of claim 6 wherein the first and second hinge are a double hinge.

10. A package formed from an integral sheet to receive an article and associated flat materials, comprising:

three tray portions including a middle tray portion and first and second end tray portions;

the middle tray portion having a first base formed with a first means for receiving the article wherein the first article receiving means is of a size less than the size of the first base, and first walls arranged with respect to the first base to define a first receiving cavity;

the first end tray portion having a second base formed with a second means for receiving the article wherein the second article receiving means is of a size less than the size of the second base, and second walls arranged with respect to the second base to define a mating surface, the first and second walls forming a first hinge which permits the first end tray portion to be inserted into the middle tray portion with the first and second receiving means aligned to secure the article, the mating surface of the first end tray portion after being inserted into the first receiving cavity of the middle tray portion defining a second receiving cavity; and the second end tray portion having a third base and third walls arranged with respect to the third base, the third base being at least half the length of the first base of the middle tray portion, the first and third walls forming a second hinge which permits the second end tray portion to be inserted into the second receiving cavity so as to form a slot between the second and third bases of the first end tray portion and the second end tray portion respectively for receiving the flat material, whereby a package for the article and the flat material is formed.

11. The package of claim 10 wherein the middle tray portion has first post receiving recesses and the first end tray portion has corresponding first posts combining with at least one of the first post receiving recess post defining a second post receiving recess, such that when the mating surface of the first end tray portion is inserted into the first receiving cavity, the corresponding first posts are inserted in the first post receiving recess to secure the first end tray portion to the middle tray portion defining the second post receiving recess, the second end tray portion having at least one second post corresponding to the second post receiving recess such that when the second end tray portion is inserted into the second receiving cavity the second post is inserted into the second post receiving recess to secure the second end tray portion to the first end tray portion.

12. A package formed from an integral sheet to receive an article and flat material associated with the article, comprising:

three tray portions including a middle tray portion and first and second end tray portions;

the middle tray portion having a first base formed with a first article receiving recess wherein the first article receiving recess is of a size less than the size of the first base, and first walls arranged with respect to the first base to define a first receiving cavity;

the first end tray portion having a second base formed with a second article receiving recess wherein the second article receiving recess is of a size less than the size of the second base, and second walls arranged with respect to the second base forming a mating surface, the first and second walls forming a first hinge which permits the first end tray portion to be inserted into the middle tray portion with the first and second receiving recesses aligned to secure the article, the mating surface of the first end tray portion after being inserted into the first receiving cavity of the middle tray portion defining a second receiving cavity;

the second end tray portion having a third base, third walls arranged with respect to the third base, and lips formed on the third walls, the third base being at least half the length of the first base of the middle tray portion, the first and third walls forming a second hinge which permits the second end tray portion to be inserted into the second receiving cavity of the first end tray portion such that the second end tray portion overlaps at least part of the aligned first and second article receiving recesses, wherein the lips engage the top of the second wall to distance the first and second bases to form a slot there between the second and third bases of the first end tray portion and the second end tray portion respectively, for receiving the flat material associated with the packaged article;

the middle tray portion has first post receiving recesses and the first end tray portion has corresponding first posts combining with at least one of the first post receiving recess defining a second post receiving recess, such that when the mating surface of the first end tray portion is inserted into the first receiving cavity defining the second post receiving recess, the corresponding first posts are inserted in the first post receiving recess to secure the first end tray portion to the middle tray portion, the second end tray portion having at least one second post corresponding to the second post receiving recess such that when the second end tray portion is inserted into the second receiving cavity the second post is inserted into the second post receiving recess to secure the second end tray portion to the first end tray portion; and the said first and second hinge is a double hinge.

* * * * *